United States Patent [19]

Giuliani et al.

[11] 4,431,520

[45] Feb. 14, 1984

[54] PROCESS FOR THE CATALYTIC HYDROCONVERSION OF HEAVY HYDROCARBONS IN LIQUID PHASE IN THE PRESENCE OF A DISPERSED CATALYST AND OF CARBONACEOUS PARTICLES

[75] Inventors: Pierre Giuliani, Grenoble; Yves Jacquin, Sevres; Christian Busson, Tassin la Demi-Lune; Jean-Francois Josserand, Grenoble, all of France

[73] Assignee: Institut Francais du Petrole, Rueil-Malmaison, France

[21] Appl. No.: 407,217

[22] Filed: Aug. 11, 1982

[30] Foreign Application Priority Data

Aug. 11, 1981 [FR] France ..... 81 15665

[51] Int. Cl.[3] ..... C10G 45/08; C10G 47/02

[52] U.S. Cl. ..... 208/112; 208/48 AA; 208/52 CT; 208/108; 208/217; 208/251 H; 208/254 H; 502/312; 502/315; 502/316; 502/337; 502/339

[58] Field of Search ..... 208/112, 108, 48 AA, 208/52 CT, 217, 251 H, 254 H; 252/477 R, 472

[56] References Cited

U.S. PATENT DOCUMENTS

| | | | |
|---|---|---|---|
| 3,978,000 | 8/1976 | Schmitt et al. | 252/477 R |
| 4,125,455 | 11/1978 | Herbstmann | 208/108 |
| 4,178,227 | 12/1979 | Metrailer et al. | 208/50 |
| 4,192,735 | 3/1980 | Aldridge et al. | 252/477 R |
| 4,204,943 | 5/1980 | Metrailer et al. | 208/50 |
| 4,227,995 | 10/1980 | Sze et al. | 208/251 H |
| 4,299,685 | 11/1981 | Khulbe et al. | 208/48 AA |

FOREIGN PATENT DOCUMENTS 2541306 4/1976 Fed. Rep. of Germany .

*Primary Examiner*—Delbert E. Gantz
*Assistant Examiner*—G. E. Schmitkons
*Attorney, Agent, or Firm*—Millen & White

[57] ABSTRACT

The hydroconversion of a heavy hydrocarbon charge containing asphaltenes and metal, sulfur and nitrogen impurities is performed in the presence of a catalyst comprising:

(a) soot particles of the cenosphere type (b) a compound of a metal selected from the groups V B, VI B, VII B and VIII of the periodic classification.

9 Claims, 3 Drawing Figures

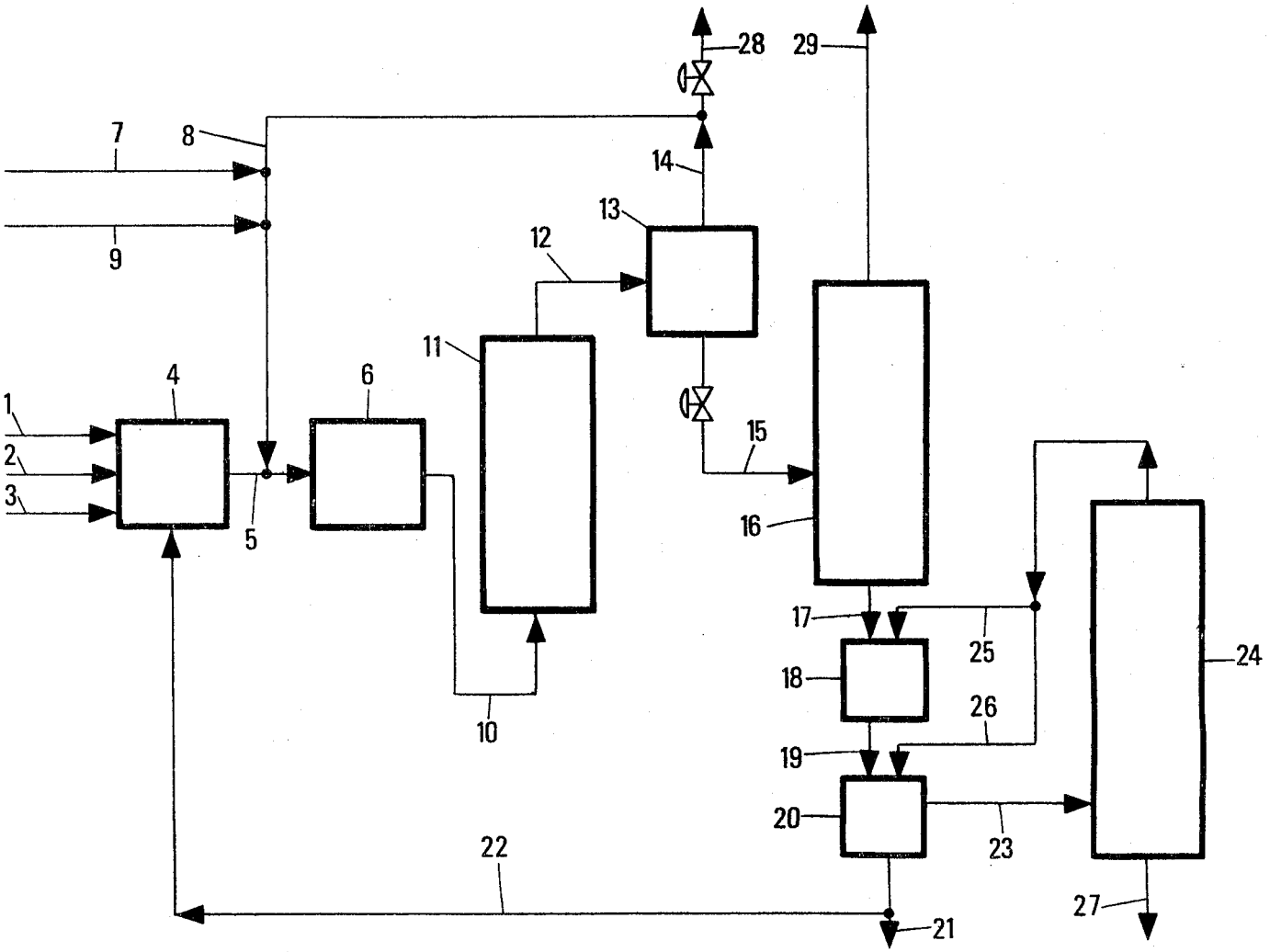
1
2
3
4
5
6
7
8
9
10
11
12
13
14
15
16
17
18
19
20
21
22
23
24
25
26
27
28
29

PROCESS FOR THE CATALYTIC HYDROCONVERSION OF HEAVY HYDROCARBONS IN LIQUID PHASE IN THE PRESENCE OF A DISPERSED CATALYST AND OF CARBONACEOUS PARTICLES

BACKGROUND OF THE INVENTION

The present invention relates to a process for the catalytic hydroconversion of heavy hydrocarbon charges containing asphaltenes and metal, sulfur and nitrogen impurities.

This process uses as the catalytic system, a combination of:

(a) at least one catalytic metal compound in solution or dispersion, with (b) soot consisting of particles, called cenospheres, formed in the combustion of heavy hydrocarbon charges, containing metal compounds, especially vanadium, nickel and iron compounds. This soot constitutes an inexpensive catalytic element.

The catalytic system of the invention is used, under hydroconversion conditions, for the conversion of a portion of the heavy components of the charge to products of lower boiling point, and results in a substantial decrease of the impurities content by hydrodemetallation, hydrodesulfuration and hydrodenitrogenation, and in a decrease of the Conradson carbon content.

Another important advantage which results from the presence of cenospheres is to allow, at the end of the reaction, an easy filtration of the residues of catalyst (a) present in the liquid reaction product.

A process for hydroconverting heavy hydrocarbon oil charges, known from U.S. Pat. No. 4,178,227 employs, as the dispersed catalyst, a combination of:

(a) a solid catalytic metal compound formed in situ from a compound of this metal soluble in the heavy oil charge, with (b) carbon-containing particles or fines thereof, resulting from coke gasification.

In this patent, the fines carried by the gas, in the course of the gasification, have an average size lower than 10 microns. They contain metals from the oil, thus usually vanadium, iron and nickel, and also the metal constituent of the catalyst metal compound, soluble in the oil, which was added.

U.S. Pat. No. 4,204,943 discloses a hydroconversion catalytic process whose catalyst consists of carbon-containing particles or fines thereof whose diameter is below 10 microns. These particles and fines result from coke gasification.

U.S. Pat. No. 4,227,995 discloses a process of catalytic hydrodemetallation wherein the catalyst consists of particles of calcined coke or green coke having a porosity lower than 0.3 cc/g and a specific surface lower than 5 $m^2/g$, 50 to 80% of the pores having diameters greater than 10,000 Angströms (1 $\mu$m).

U.S. Pat. No. 4,299,685 discloses a process for hydrocracking a heavy oil, the catalyst consisting of fly ash; fly ash consists of particles of high minerals content and low carbon content; when examined with an electronic microscope, they have a smooth appearance. Their porosity is low, of about 0.3 to 0.4 cc/g.

SUMMARY AND DISCUSSION OF THE INVENTION

It has been found that at least partly substantially spherical carbon-containing particles, called cenospheres, obtained by combustion of heavy industrial fuel oils, when admixed with a metal compound dissolved or finely divided in the charge, constitute and efficient catalyst for hydroconverting heavy hydrocarbon charges, with excellent yields in the conversion of the heavy fractions to lighter fractions, in hydrodemetallation, hydrodesulfuration and hydrodenitrogenation.

The characteristics of these cenospheres make them a very efficient and inexpensive material to transport the insoluble materials and the metals formed in the course of the hydroconversion. Their high metal (Fe, Ni, V) content (about 1 to 10% b.w., in totality, of the three metals) makes them endowed with a catalytic cracking, hydrogenation and demetallation activity. Finally their roughly spherical shape and their relatively large size makes easy their removal by filtration without plugging of the filters.

Representative cenospheres contain, by weight, 0.1 to 2% of vanadium (preferably 0.4 to 2%), 0.1 to 5% of iron (preferably 0.4 to 2%) and 0.2 to 1% of nickel (preferably 0.5 to 1%), these values being not limitative.

They also contain carbon, for example 60 to 90% b.w., and sulfur, for example 2 to 10% b.w., as well as conventional elements such as Na and Ca.

The specific surface of the cenospheres is quite variable, generally between 2 and 130 $m^2/g$, preferably 2 to 20 $m^2/g$.

The cenospheres, when observed with an electronic microscope, have a porous appearance, similar to that of pumice or of a sponge.

FIG. 3 illustrates an embodiment of the process.

Figure 1:
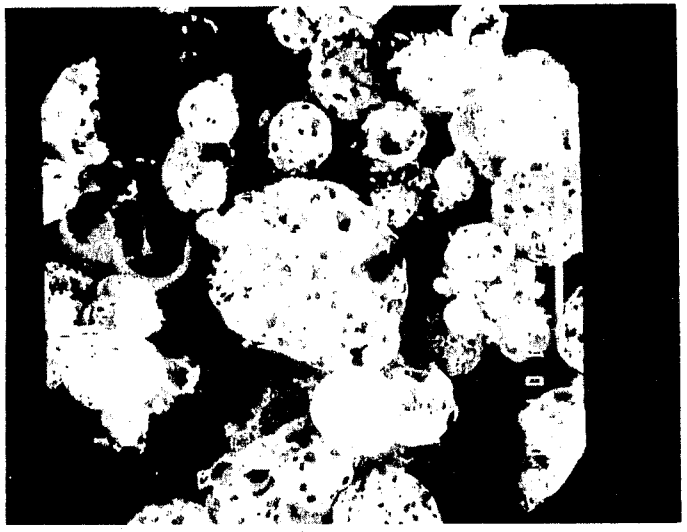
FIG. 1 is a 400 times enlargement of a cenospheres group.
Figure 2:
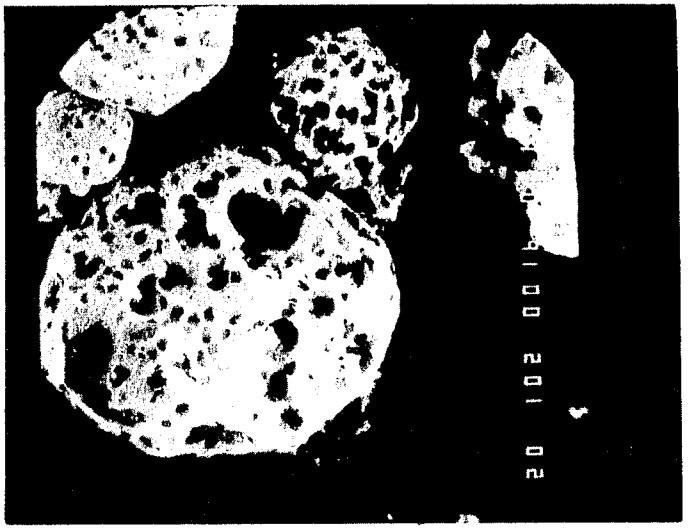
FIG. 2 is a 1000 times enlargement of a cenospheres group.

It is commonly admitted that the cenospheres result from the cracking of fuel oil droplets. They distinguish from elemental soot particles whose size is only of a few hundreds of Angströms (1 Å$=10^{-10}$ meter), although these particles are liable to assemble to form much longer chains.

The average diameter of the cenospheres is usually greater than 10 $\mu$m, for example between 10 and 200 $\mu$m or between 20 and 200 $\mu$m, more particularly between 20 and 60 $\mu$m.

Their particle density ranges usually from 0.3 to 0.8 $g/cm^3$, preferably 0.4 to 0.6 $g/cm^3$, and their structural density usually from 1.2 to 2.5 $g/cm^3$, preferably 1.3 to 2.1 $g/cm^3$.

Their total pore volume ranges usually from 0.8 to 2.5 $cm^3/g$, preferably from 1.2 to 1.7 $cm^3/g$.

Certain initially spherical cenospheres may have been broken and the invention also concerns the use of these broken cenospheres.

Hydroconversion designates a process wherein a portion of the heavy constituents of the charge is converted under hydrogen pressure, at high temperature, to products of lower boiling point.

According to the invention, heavy hydrocarbon charges are upgraded by a hydroconversion process which comprises:

1. adding to the hydrocarbon charge:

(a) at least one catalytic metal compound, preferably as a solution in a solvent, for example in water or in a hydrocarbon solvent, the metal of the compound belonging to at least one of the groups VB, VIB, VIIB and VIII, and (b) cenospheres, 2. maintaining the resultant mixture under hydroconversion conditions, and 3. fractionating the resultant products.

The process, which is the object of this invention, may be applied to heavy hydrocarbon charges containing asphaltenes and metal, sulfur and nitrogen impurities. These heavy charges comprise:

crude oils and fractions extracted therefrom, heavy fractions obtained from oil, such as atmospheric or vacuum residues, asphalts obtained in deasphalting units, tars, bitumens, products from bituminous sands and shales, liquid fractions of high asphaltene content from coal liquefaction.

This process is particularly well adapted to the heaviest hydrocarbon charges having a Conradson carbon residue of up to 50% b.w. These charges have also very high asphaltene contents (for example, up to 40%), sulfur contents (for example, up to 8%) and metal contents (for example, up to 3000 ppm).

The catalytic metal compound used in the invention is a finely divided metal compound preferably obtained from a metal compound soluble in the charge or from an aqueous solution of a metal salt which is dispersed in the charge or, intermediately, in a hydrocarbon solvent.

The metal compound soluble in the charge can be selected from:

inorganic metal compounds such as halides, oxyhalides, polyheteroacids, for example: phosphomolybdic acid, molybdenum blues, alkyldithiophosphoric acid, metal salts of an organic aliphatic, naphthenic or aromatic acid, a sulfonic acid, a sulfinic acid, a xanthic acid, a mercaptan, a phenol or a polyhydroxy aromatic compound, metal chelates, such as $\beta$-ketonic complexes, penta and hexacarbonyls, complexes with ethylenediamine, ethylenediaminetetracetic acid and phthalocyanines, heteroacid salts or organic amines or corresponding quaternary ammonium salts.

The metal constituent of these compounds which are soluble and convertible to a dispersed solid catalyst belongs to groups VB, VIB, VIIB and/or VIII of the Table published by E. H. Sargent in 1962. The preferred metals are molybdenum, vanadium, chromium, tungsten, manganese, iron, nickel and cobalt. The preferred compounds are molybdenum naphthenate and molybdenum blue.

The proporation of soluble metal compound added to the charge is comprised, for example, between 10 and 1000 ppm, preferably between 50 and 500 ppm, as weight of metal with respect to the charge. The metal compound may be added either alone or admixed with one or several compounds of other metals.

The metal compound, dissolved in an aqueous solution, optionally pre-emulsified with a hydrocarbon, can be, for example, ammonium heptamolybdate or an alkali metal heptamolybdate, cobalt nitrate, nickel nitrate, ferrous sulfate or sodium tungstate.

The preferred compound is ammonium heptamolybdate either alone or in admixture with another water-soluble metal compound.

The amount of metal compound dissolved in the emulsified aqueous solution is comprised between 10 and 1000 ppm, preferably between 50 and 500 ppm, as weight of metal.

The cenospheres are recovered, in most cases, from the dustremoval plants of large power plants burning heavy industrial fuel oils, particularly fuel oil No. 2.

These cenospheres are admixed with the charge in a proportion of 0.1 to 5% b.w. thereof.

The charge containing the cenospheres, the soluble metal compound or the metal salt supplied as an aqueous solution or emulsion can be optionally subjected to a pretreatment.

This pretreatment has for object to convert the metal compound or the metal salt to a finely dispersed solid catalyst comprising from 10 to 1000 ppm, preferably from 50 to 300 ppm b.w. of active matter, calculated as elemental metal, based on the weight of the charge. The pretreatment is effected in the presence of hydrogen sulfide alone or in admixture with hydrogen at a temperature comprised between 200° and 450° C. and a pressure comprised between 25 and 250 bars. During this pretreatment, a portion or the totality of the metals contained in the cenospheres is also converted to metal sulfides.

When no pretreatment is performed, the charge, admixed with the constituents of the catalytic system, is supplied to the hydroconversion reactor where the metal compound or the metal salt and the metals contained in the cenospheres are converted to metal sulfides by action of the sulfur of the charge and/or the sulfur compounds formed in the course of the reaction, particularly $H_2S$.

FIG. 3 illustrates an embodiment of the process given by way of example.

The fresh charge, the soluble metal compound or the emulsion of an aqueous solution of a metal salt in a hydrocarbon are supplied respectively through ducts 1,2 and 3 to a mixing drum 4.

This mixture is pumped (duct 5) and fed to a pretreatment reactor 6 where it is contacted with hydrogen containing 2 to 10% of hydrogen sulfide. This hydrogen is a mixture of fresh hydrogen (duct 7) and recycle hydrogen (duct 8). Hydrogen sulfide is supplied either by recycling (duct 8) or by fresh supply (duct 9). In this pretreatment, the temperature is between 200° and 450° C., preferably 350°–450° C., the pressure between 25 and 250 bars, preferably 100–200 bars, the reaction time between 5 mn and 4 h, preferably 10 mn to 2 h.

The pretreated material is supplied (duct 10) to the hydroconversion reactor (11). The temperature of this reactor is between 380° and 480° C., preferably between 420° and 460° C., the hydrogen partial pressure between 25 and 250 bars, preferably between 100 and 200 bars, the hydrogen feed rate between 1000 and 5000 liters (NTP) per liter of charge, preferably between 1000 and 2000 l/l and the space velocity (VVH), defined as the volume or charge per hour and per volume of the reactor, between 0.1 and 10, preferably between 0.25 and 5.

The stream discharged from the hydroconversion reactor through duct 12 comprises gas and a liquid containing suspended solids. It is supplied to a high pressure separator 13. A gas containing hydrogen, hydrogen sulfide and light hydrocarbons is discharged from the separator (duct 14). A portion of this gas is recycled, after treatment for removing hydrogen sulfide, to the pretreatment reactor or to the hydroconversion reactor if no pretreatment is performed. The other portion is discharged (28) to maintain the partial hydrogen and hydrogen sulfide pressures at the prescribed levels.

A liquid product containing suspended solids is discharged through duct 15 and through an expansion valve.

This mixture can be treated by different methods, based on known technologies. These treatments are selected, in accordance, for example, with the properties of the charge, the severity of the hydroconversion and the use of the end products.

A treatment illustrated by the accompanying figure is described below.

The liquid product, discharged from the separator 13 through duct 15, is passed through a low pressure separator (not shown) wherefrom water can be purged. It is then introduced (duct 15) into a fractionation unit 16 wherefrom one or more fractions are removed (17 and 29).

This fractionation unit may be a mere vacuum vaporizer or a vacuum distillation column. The fractionation of the distillate and the residue is controlled, so as to obtain a residue able to flow and to be pumped under industrial conditions.

The residue discharged through duct 17 is admixed in drum 18 with an aromatic solvent whose boiling point is between 100° and 220° C. and which is introduced through duct 25. This solvent decreases the viscosity and leads to a phase which is treated in a separation unit 20, joined to 18 through duct 19. In this separation unit, the solids are separated by filtration, centrifugation or decantation.

The filtered or centrifuged solids are washed with the same aromatic solvent (duct 26), in the separation unit 20, to eliminate the oily products which coat the catalytic metal sulfides, the sulfides of the metals of the charge, the cenospheres more or less charged with metals and metal sulfides and the materials insoluble in the aromatic solvent.

A fraction of these solids is eliminated through duct 21. They can be burnt, gasified or treated to recover the metals. The other fraction is recycled through the intermediate mixing drum 4 to the hydroconversion reactor (duct 22), the residual aromatic solvent being either recovered or discharged.

The liquid phase recovered in the separation unit 20, admixed with the washing solvent, is fed through duct 23 to a distillation unit 24.

The aromatic solvent, discharged from the top of this unit, is re-injected into mixer 18 through duct 25 and into separation unit 20 through duct 26, in order to wash the filtered or centrifuged solids. The hydrotreated residue (duct 27) is recovered at the bottom of the distillation column 24; it is substantially free of metals, sulfur, nitrogen and asphaltenes. This residue is burnt, gasified or diluted to yield a heavy fuel oil No. 2.

It must be noted that, when recycling a part of the solid products from the separation unit 20, it is possible either to decrease, or even to periodically interrupt the supply of fresh metal compound in the charge. The amount of this fresh metal compound is selected according to the desired level of activity.

EXAMPLE

Experimental Procedure (a) Test in batch

There is used a 250 ml autoclave of stainless steel. The gas-liquid contact is obtained with a shaking stirrer.

A test is effected with 30 g of charge. The autoclave, after introduction of the soluble molybdenum compound, the cenospheres and the charge, is closed and weighed at atmospheric pressure, scavenged with hydrogen and pressurized with hydrogen to 100 bars for one hour to control tightness.

The autoclave is filled with hydrogen under 100 bars at room temperature and then brought to the test temperature in ¾ h to 1 h, depending on the temperature. The reaction time corresponds to the temperature threshold. Cooling is effected in open air.

When a pretreatment is performed, the autoclave is first filled with hydrogen sulfide under 10 bars, then hydrogen is added up to 100 bars. Heating is performed at 380° C. for 1 hour; after cooling to room temperature, the pressure is released, scavenging with hydrogen is performed and the experiment is renewed as indicated above.

After cooling, the gas of the autoclave is expanded, washed with sodium hydroxide, measured with a meter and analysed by gas phase chromatography.

The reaction mixture is diluted with toluene and filtered. The solids are washed with hot toluene. The two toluenic solutions, the filtration solution and the washing solution, are evaporated at 100° C. under 0.025 bar. The hydrocarbons scavenged with toluene are analysed. The evaporation residue constitutes the hydroconverted product.

The balance must be higher than 95% b.w. for a test to be considered as valid.

(b) Continuous test

The charge containing the soluble metal compound and the cenospheres is admixed in line with hydrogen containing 3 to 7% of hydrogen sulfide, then raised to the reaction temperature by passage through a furnace comprising five heating elements. It is then fed to the bottom of a reactor consisting of a vertical pipe. The reactor effluent is cooled to 150° C. and passed through a high pressure separator. The gas discharged from this separator is recycled after washing with water. The hydrogen and hydrogen sulfide partial pressures are controlled by purging. The hydroconverted product is discharged at the bottom of the high pressure separator.

Two charges have been used in the examples (Table I): a Safanya vacuum residue and asphalt recovered from a pentane deasphalting unit used to treat the same vacuum residue; this asphalt is diluted with 35% by volume of gas oil.

TABLE I

| | SAFANYA VACUUM RESIDUE | DILUTED SAFANYA ASPHALT |
|---|---|---|
| $d_4^{20}$ | 1.030 | 1.063 |
| Viscosity at 100° C. in cSt ($mm^2/s$) | 3075 | 718 |
| S % b.w. | 5.17 | 5.55 |
| Ni ppm b.w. | 42 | 75 |
| V ppm b.w. | 132 | 270 |
| Asphaltenes (n $C_7$) % b.w. | 11.7 | 19.1 |
| Conradson carbon % b.w. | 22.2 | 26.1 |

The cenospheres had the following properties:

| | |
|---|---|
| particle density | 0.56 $g/cm^3$ |
| structural density | 2.04 $g/cm^3$ |
| average diameter | 43.9 μm |
| total pore volume | 129.6 $cm^3/100$ g |
| specific surface | 6.5 $m^2/g$ |
| carbon % b.w. | 81.45 |
| hydrogen % b.w. | 0.49 |
| Vanadium % b.w. | 1.55 |
| nickel % b.w. | 0.61 |
| iron % b.w. | 1.23 |
| sulfur % b.w. | 7.22 |

EXAMPLE 1

30 g of Safanya asphalt diluted with 35% by volume of gas oil are treated in batch at 420° C. for 2 hours;

hydrogen initial pressure: 100 bars; no pretreatment. Various tests are effected: without catalyst, with cenospheres alone, with molybdenum naphthenate alone, with molybdenum naphthenate plus cenospheres.

Table II summarizes the results obtained in these tests.

TABLE II

| TEST No. | 278 | 301 | 291 | 292 | 304 |
|---|---|---|---|---|---|
| molybdenum naphthenate ppm of Mo (b.w.) | 0 | 0 | 500 | 500 | 200 |
| Cenospheres, weight in g. | 0 | 0.3 | 0 | 0.3 | 0.3 |
| Conversion of the asphaltenes(1) (n $C_7$) % | 27 | 47 | 45 | 48 | 48 |
| Hydrodesulfuration % | 7 | 17 | 40 | 42 | 40 |
| Hydrodemetallation (V + Ni) % | 10 | 80 | 86 | 99 | 94 |
| Insoluble in toluene, % b.w. of the charge | 12 | 10 | 0.1 | 0.2(2) | 0.2(2) |
| $C'_3/C_3$ by volume(3) | 0.1 | 0.08 | 0.01 | 0.01 | 0.02 |

(1)according to AFNOR standard
(2)including the weight of the cenospheres
(3)propylene/propane ratio, indicating the hydrogenating power of the catalyst The addition of cenospheres to molybdenum naphthenate thus significantly improves the demetallation without substantially increasing the amount of insoluble matter.

The cenospheres, when used alone (test No. 301), as compared with the purely thermal test No. 278, have already a hydrogenating and desulfurizing activity, as shown by the $C'_3/C_3$ ratio and the hydrodesulfuration percentage.

The censopheres allow the fixation of vanadium, nickel and molybdenum.

No molybdenum can be found in the liquid hydrotreated product.

EXAMPLE 2

The tests of this example are performed in the same conditions as in example 1. The soluble molybdenum compound is now molybdenum blue as a 5.8% solution is a $C_7$–$C_9$ alcohol.

Table III summarizes the results of these tests.

TABLE III

| TEST No. | 278 | 301 | 282 | 284 | 283 |
|---|---|---|---|---|---|
| molybdenum blue, ppm Mo b.w. | 0 | 0 | 500 | 500 | 200 |
| Cenospheres, weight in g. | 0 | 0.30 | 0 | 0.30 | 0.30 |
| Conversion of the asphaltenes(1) % | 27 | 47 | 45 | 45 | 42 |
| Hydrodesulfuration % | 7 | 17 | 39 | 43 | 40 |
| Hydrodemetallation % | 10 | | 81 | 95 | 94 |
| Insoluble in toluene % b.w. of the charge | 12 | 10 | 0.1 | 0.20(2) | 0.25 |
| $C'/C_3$ | 0.1 | 0.08 | 0.01 | 0.01 | 0.03 |

(1)n $C_7$ asphaltenes according to AFNOR standard
(2)weight of the cenospheres included.

These test confirm the results obtained with molybdenum naphthenate: the presence of cenospheres increases the hydrodemetallizing activity and reduces the weight of insoluble matter.

EXAMPLE 3

The operation is performed as in example 1, except that 0.5% b.w., with respect to the charge, of cenospheres recovered at the end of example 1 and washed with hot toluene are added to the hydrocarbon charge, in addition to cobalt naphthenate and cenospheres. The addition of recovered cenospheres allows, as shown in Table IV, a reduction of the supply of fresh molybdenum naphthenate to 100 ppm, without significant modification of the results.

TABLE IV

| TEST No. | 292 | 304 | 305 |
|---|---|---|---|
| Charge, weight in g. | 30 | 30 | 30 |
| naphthenate (ppm Mo b.w.) | 500 | 200 | 100 |
| Cenospheres, weight in g. | 0.30 | 0.30 | 0.30 |
| Insoluble recycled in g. | 0 | 0 | 0.15 |
| Conversion of the asphaltenes (n$C_7$) % | 48 | 48 | 46 |
| Hydrodesulfuration % | 42 | 40 | 39 |
| Hydrodemetallation % | 99 | 94 | 93 |
| Weight of the insoluble in toluene g | 0.2 | 0.2 | 0.3 |
| $C'_3/C_3$ b.w. | 0.01 | 0.02 | 0.02 |

EXAMPLE 4

The continuous method described above is used with a Safanya vacuum residue.

The charge is admixed with molybdenum naphthenate (500 ppm b.w. of molybdenum) and 1% b.w. of cenospheres identical to those of example 1. It is introduced in a proporation of 1 liter/h into the pretreating furnace, where it is heated to 430° C., temperature at which it is fed to the reaction chamber.

The total pressure is 150 bars. Recycled hydrogen is introduced in line just before the preheater, with a $H_2$/hydrocarbon ratio of 1000 liters per liter, the hydrogen amount being given under normal temperature and pressure conditions. Hydrogen contains 2 to 3% of hydrogen sulfide. The space velocity, i.e. the volume of charge per hour and per volume of reactor, is 1.2, which corresponds to a residence time of 54 minutes in the reactor.

Table V shows the results obtained after 100 h of run in the above conditions.

TABLE V

| | |
|---|---|
| Temperature of the preheater output °C. | 430 |
| Temperature of the reactor input °C. | 430 |
| Pressure bars | 150 |
| $H_2$/HC liters NTP/liter | 1000 |
| v/v/h | 1.2 |
| No catalyst, ppm b.w. | 500 |
| Cenospheres % b.w. | 1 |
| Conversion of the asphaltenes % | 41 |
| Hydrodemetallation % | 90 |
| Hydrodesulfuration % | 35 |
| Insuluble in toluene % b.w. | 0.9 |

EXAMPLE 5

The continuous method described above is used with a Safanya asphalt diluted with 50% of light cycle oil. The resultant mixture has the following properties:

| | |
|---|---|
| $d_4^{20}$ | 1.056 |
| viscosity at 50° C. in cSt ($mm^2/s$) | 1760 |
| S % b.w. | 5.47 |
| nickel, ppm b.w. | 62 |
| Vanadium, ppm b.w. | 190 |
| asphaltene (n$C_7$) % b.w. | 15.2 |
| Conradson carbon % b.w. | 23 |

Two tests are conducted under strictly identical operating conditions, as indicated in Table VI.

In the first test (111), molybdenum naphthenate is used alone; in the second test (112), cenospheres are added to molybdenum naphthenate in a proportion of 2% b.w. of the charge.

In each case, after 24 h a balance is made at 405° C., 417° C. and 430° C. The hydroconverted products discharged at the bottom of the high pressure separator are subjected to filtration test in the following conditions:

| | |
|---|---|
| Millipore filter under pressure | |
| nitrogen pressure | 4 bars |
| filtration surface | 11.3 $cm^2$ |
| diameter of the filter pores | 0.2 μm |
| filtered amount | 60 g |
| filtration temperature | 20–22° C. |

Table VI gives the filtration rates and the viscosities at 50° C. for these products.

It appears vary clearly that, under identical filtration conditions and with substantially the same viscosities, the presence of the above described cenospheres makes the filtration and separation of the catalyst easier, in view of an optional recycling. Everything occurs as if these carbonaceous particles were operating as a filtration aid.

By way of comparison, there are given filtration times obtained with other filtration aids. Only Celite (trade mark) gives equivalent results; the advantage of cenospheres lies in the possibility to burn them after use.

TABLE VI

| Test No. | 111 | | | 112 | | |
|---|---|---|---|---|---|---|
| Pressure bars | 200 | | | 200 | | |
| $H_2$/HC liters NTP | 1000 | | | 1000 | | |
| Catalyst Mo ppm (b.w.) | 500 | | | 500 | | |
| Cenospheres % b.w. | 0 | | | 2 | | |
| V.V.H. | 0.4 | | | 0.4 | | |
| Temperature °C. reactor | 405 | 417 | 430 | 405 | 417 | 430 |
| Conversion 500° C.+ to 500° C.− % b.w.(1) | 33 | 52 | 69 | 37 | 57 | 73 |
| Viscosity at 50° C. of the product discharged from the high pressure separator in centistokes(2) ($mm^2/s$) | 31 | 14 | 7.5 | 27 | 11 | 6.9 |
| Filtration time in hours | impossible(3) | 12 | 2.45 (4) | 6 | 1 | 0.25 |

TABLE VI-continued (1)determined by chromatography;
(2)temperature of the separator: 250° C.;
(3)impossible at 20–22° C.
(4)By way of comparison, when adding cenospheres before filtration, the filtration time is 0.5 hour. It is 4 h with fly ash, 2.5 h with alumina of particle size 20–55 μm, 4 h with Freyming coal (20% of refuse through a 80 μm sieve) and 0.5 h with Celite (trade mark) (20% of refuse through a sieve of 150 mesh = 80 μm).

What is claimed is:

1. A process for converting a heavy hydrocarbon charge containing asphaltenes and metal, sulfur and nitrogen impurities, in order to obtain products of lower boiling point and lower impurities content, wherein a mixture of said charge with hydrogen is contacted under hydroconversion conditions with a catalyst composition comprising at least two essential components:
   (a) soot of the cenosphere type, resulting from the combustion of liquid heavy hydrocarbon charges containing at least one metal of the iron, nickel and vanadium group, said metal being also present in said soot, and
   (b) at least one catalytic metal compound distinct from the components: (a) and selected from the compounds of metals of groups VB, VIB, VIIB and VIII.

2. A process according to claim 1, wherein component (b) is added to the hydrocarbon charge in the form of a solution in a hydrocarbon solvent, a solution in a non-hydrocarbon solvent or an emulsion of an aqueous solution in a hydrocarbon solvent.

3. A process according to claim 1, wherein the particles of soot of the cenosphere type have an average diameter of 10 to 200 μm and contain 60 to 90% by weight of carbon and 1 to 10% by weight of metals of the iron, nickel and vanadium group.

4. A process according to claim 3, wherein the soot of the cenosphere type contains, by weight, 0.1 to 2% of vanadium, 0.1 to 5% of iron and 0.2 to 1% of nickel.

5. A process according to claim 1, wherein the cenospheres have a specific surface of 1 to 130 $m^2/g$, a total pore volume of 0.8 to 2.5 $cm^3/g$, a particle density of 0.3 to 0.8 $g/cm^3$ and a structural density of 1.2 to 2.5 $g/cm^3$.

6. A process according to claim 1, wherein the cenospheres have a specific surface of 2 to 20 $m^2/g$, a total pore volume of 1.2 to 1.7 $cm^3/g$, a particle density of 0.4 to 0.6 $g/cm^3$ and a structural density of 1.3 to 2.1 $g/cm^3$.

7. A process according to claim 1, wherein the amount of cenospheres is 0.1 to 5% by weight of the hydrocarbon charge and the amount of element (b) from 10 to 1000 ppm by weight of said charge.

8. A process according to claim 1, wherein the hydrocarbon charge, after introduction of the two catalyst elements, is treated with hydrogen sulfide, before being subjected to the conversion process.

9. A process according to claim 1, wherein the metal of compound (b) is selected from the group consisting molybdenum, vanadium, chromium, tungsten, manganese, iron, nickel or cobalt.

* * * * *

UNITED STATES PATENT AND TRADEMARK OFFICE

CERTIFICATE OF CORRECTION

PATENT NO. : 4,431,520

DATED : February 14, 1984

INVENTOR(S) : PIERRE GIULIANI ET AL

It is certified that error appears in the above-identified patent and that said Letters Patent is hereby corrected as shown below:

Column 10, line 24: reads " from the components (a) and selected from the com- "
should read -- from component (a) and selected from the com- -- .

Column 10, line 56: reads " of compound (b) is selected from the group consisting "
should read -- of compound (b) is -- .

Signed and Sealed this

*Twenty-second* Day of *May 1984*

[SEAL]

*Attest:*

GERALD J. MOSSINGHOFF

*Attesting Officer*

*Commissioner of Patents and Trademarks*